US005612587A

United States Patent [19]

Itoh et al.

[11] Patent Number: 5,612,587

[45] Date of Patent: Mar. 18, 1997

[54] FIELD EMISSION CATHODE

[75] Inventors: Shigeo Itoh; Teruo Watanabe; Kazuhiko Tsuburaya, all of Mobara; Junji Itoh; Seigo Kanemaru, both of Tsukuba, all of Japan

[73] Assignees: Futaba Denshi Kogyo K.K., Mobara; Agency of Industrial Science and Technology, Tsukuba, both of Japan

[21] Appl. No.: 438,082

[22] Filed: May 8, 1995

Related U.S. Application Data

[63] Continuation of Ser. No. 37,592, Mar. 26, 1993, abandoned.

[30] Foreign Application Priority Data

Mar. 27, 1992 [JP] Japan ..... 4-071219

[51] Int. Cl.[6] ..... H01J 1/02

[52] U.S. Cl. ..... 313/309; 313/336; 313/351

[58] Field of Search ..... 313/309, 336, 313/351, 512; 445/24, 50, 51

[56] References Cited

U.S. PATENT DOCUMENTS

| | | | |
|---|---|---|---|
| 3,588,565 | 6/1971 | Trump | 313/309 |
| 4,578,614 | 3/1986 | Gray et al. | 313/336 |
| 5,053,673 | 10/1991 | Tomii et al. | 313/336 |
| 5,140,219 | 8/1992 | Kane | 313/351 |
| 5,153,483 | 10/1992 | Kishino et al. | 315/349 |
| 5,170,092 | 12/1992 | Tomii et al. | 313/336 |
| 5,189,341 | 2/1993 | Itoh et al. | 313/309 |
| 5,196,767 | 3/1993 | Leard et al. | 313/309 |
| 5,202,602 | 4/1993 | Ayers | 313/351 |
| 5,212,426 | 5/1993 | Kane | 313/309 |
| 5,214,347 | 5/1993 | Gray | 313/309 |
| 5,217,401 | 6/1993 | Watanabe et al. | 313/309 |
| 5,229,331 | 7/1993 | Doan et al. | 313/309 |
| 5,229,682 | 7/1993 | Komatsu | 313/336 |
| 5,256,936 | 10/1993 | Itoh et al. | 313/495 |

*Primary Examiner*—Ulysses Weldon
*Assistant Examiner*—Lun-Yi Lao
*Attorney, Agent, or Firm*—Oblon, Spivak, McClelland, Maier & Neustadt, P.C.

[57] ABSTRACT

A field emission cathode capable of reducing an operation voltage and substantially preventing damage of an emitter. An emitter is provided on a substrate. The emitter includes a base and a plurality of rectangular tips projecting from the base. A gate is arranged in a recess formed on the substrate so as to be in proximity to the emitter. A width a of the tips of the emitter and an interval b between the tips are defined to satisfy a relationship of b/a=2. This permits an electric field strength applied to the tips of the emitter to be substantially increased as compared in a conventional field emission cathode of b/a≦1, resulting in an operation voltage being reduced and a sufficient amount of emitter current being produced.

6 Claims, 10 Drawing Sheets

FIELD EMISSION CATHODE

This application is a Continuation of application Ser. No. 08/037,592, filed on Mar. 26, 1993, now abandoned.

BACKGROUND OF THE INVENTION

This invention relates to a field emission cathode, and more particularly to a field emission cathode which is conveniently used as an electron source for various kinds of equipments such as a display device, a light source, an amplification element, a high-speed switching element, a sensor and the like.

A field emission cathode is greatly increased in electric current emitted therefrom when strength of an electric field applied to an emitter from an exterior thereof is increased. For this purpose, a number of field emission cathodes each including an emitter having tips sharply pointed were proposed. Such conventional field emission cathodes each are typically constructed, for example, in such a manner as shown in FIGS. 11A and 11B. More particularly, the conventional field emission cathode is so constructed that a gate 100 and an emitter 102 having tips 101 formed into a sawtooth-like shape are arranged on an insulating substrate 103 with a groove 104 being interposed therebetween.

Unfortunately, the conventional field emission cathode constructed as described above has a disadvantage in that it is highly difficult to form the tips 101 of the emitter 102 into a uniform sharp shape with good reproducibility. This causes distances between the tips 101 of the emitter 102 and the gate 100 to be non-uniform, resulting in characteristics of the emitter 102 being substantially varied, leading to deterioration in serviceability of the field emission cathode.

In view of the foregoing, the inventors proposed a field emission cathode constructed as shown in FIGS. 10A and 10B. More specifically, in the field emission cathode proposed, an emitter 110 is constituted by a base section 111 and a plurality of tip sections 112 formed into a rectangular shape so as to project from the base section 111. The tip sections 112 are arranged so as to be in close proximity to a gate 113 at microdistances as small as submicrons, to thereby substantially eliminate a variation of characteristics of the emitter 110 and permit the tip sections 112 to be uniformly formed with good reproducibility.

Nevertheless, the field emission cathode proposed causes a voltage which is to be applied to the gate 113 or an operation voltage to be increased as compared with the field emission cathode shown in FIGS. 11A and 11B. Also, it has another disadvantage that the tip sections 112 are damaged or injured due to electrostatic attraction acting between the rectangular tip sections 112 of the emitter 110 and the gate 113.

In the conventional field emission cathode shown in FIGS. 10A and 10B, a relationship of a width of each of the rectangular tip sections 112 to an interval between each adjacent two of the tips 112 is not specifically defined and is set to be approximately 1:1.

SUMMARY OF THE INVENTION

The present invention has been made in view of the foregoing disadvantages of the prior art while taking notice of the fact that as a result of a careful study by the inventors, a relationship of a width of each of rectangular tips to an interval between each adjacent two of the tips is a very important or critical parameter which dominates characteristics of the field emission cathode. Also, it was found that an increase in mechanical strength of the rectangular tips of the emitter prevents damage of the emitter due to electrostatic attraction.

Accordingly, it is an object of the present invention to provide a field emission cathode which is capable of significantly reducing an operation voltage.

It is another object of the present invention to provide a field emission cathode which is capable of effectively preventing an emitter from being damaged.

In accordance with the present invention, a field emission cathode is provided. The field emission cathode includes an emitter and a gate. The emitter includes a base and a plurality of rectangular tips provided on the base so as to outwardly project therefrom. The tips are formed so as to satisfy a relationship of $b/a>1$, wherein a is a width of each of the tips of the emitter and b is an interval between each adjacent two of the tips.

In a preferred embodiment of the present invention, an area between the tips and the base is formed into a predetermined curvature radius.

In a preferred embodiment of the present invention, an electrode layer is arranged on the emitter so that a distal end of the electrode layer is located at a position retracted from a distal end of the tips of the emitter.

The above-described construction of the field emission cathode according to the present invention permits strength of an electric field applied to the tips of the emitter to be substantially increased as compared with that in the prior art, to thereby decrease an operation voltage.

Also, when the field emission cathode of the present invention, as described above, is so constructed that radiusing is carried out between the base of the emitter and the tips thereof and the electrode layer is provided on the emitter, the rectangular tips of the emitter are increased in mechanical strength to a degree sufficient to prevent damage of the emitter due to electrostatic attraction and the emitter is decreased in electric resistance to increase the amount of electric current emitted from the emitter.

BRIEF DESCRIPTION OF THE PREFERRED EMBODIMENTS

These and other objects and many of the attendant advantages of the present invention will be readily appreciated as the same becomes better understood by reference to the following detailed description when considered in connection with the accompanying drawings; wherein:

FIG. 9 is a fragmentary perspective view showing a yet further embodiment of a field emission cathode according to the present invention, which is embodied into a suitable structure such as a structure of a thin film configuration, a wedge configuration or the like;

BRIEF DESCRIPTION OF THE PREFERRED EMBODIMENTS

Now, a field emission cathode according to the present invention will be described hereinafter with reference to FIGS. 1A to 9.

Figure 1A:
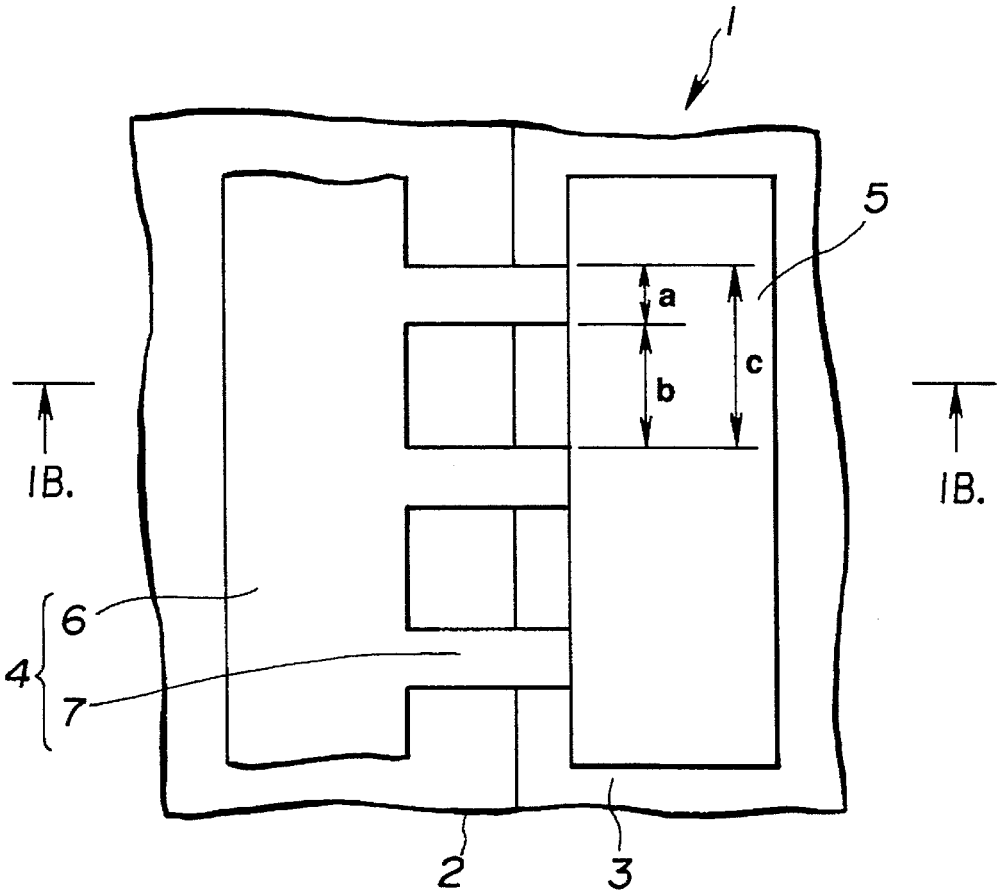
FIG. 1A is a fragmentary plan view showing a first embodiment of a field emission cathode according to the present invention.
Figure 1B:
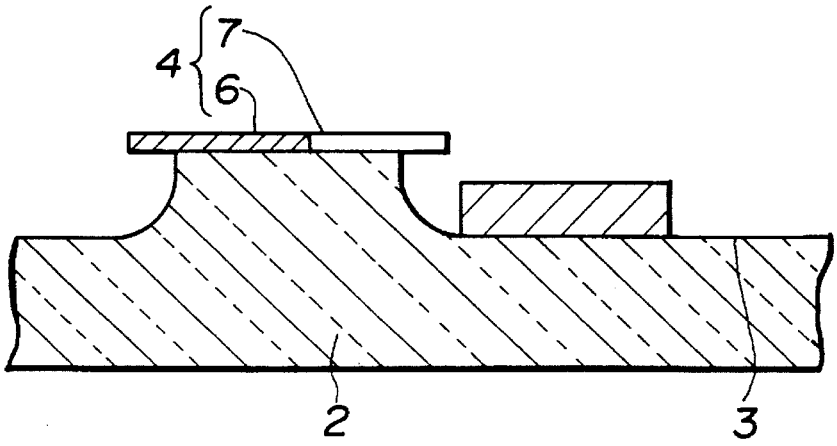
FIG. 1B is a vertical sectional view taken along line 1B—1B of FIG. 1A.
Figure 2:
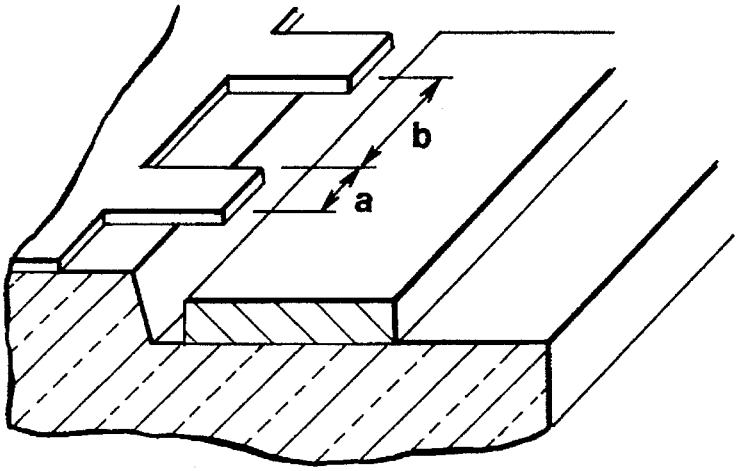
FIG. 2 is a fragmentary perspective view of the field emission cathode shown in FIG. 1A.

Referring First to FIGS. 1A to 2, a first embodiment of a field emission cathode according to the present invention is illustrated. A field emission cathode of the illustrated embodiment which is generally designated at reference numeral 1 includes a substrate 2 made of an insulating material such as quartz or the like and formed thereon with a recess 3. The substrate 2 is formed on a portion thereof other than the recess 3 with an emitter 4. Also, the recess 3 of the substrate 2 is formed on a bottom thereof with a gate 5 in a manner to be in proximity to the emitter 4.

The emitter 4 includes a base 6 and a plurality of rectangular tips 7 formed so as to outwardly project therefrom and face the gate 5, resulting in a structure being generally formed into a rectangular pectinate configuration.

In the illustrated embodiment, a relationship between a width a of each of the tips 7 of the emitter 4 and an interval b between each adjacent two of the tips 7 is defined to be $b/a>1$. Preferably, the relationship is defined so as to be $b/a=2$. When a pitch of the tips 7 is represented by c, a dimensional condition of the tips 7 may be defined to be $c/a=(b+a)/a=3$.

In the illustrated embodiment, the emitter 4 is formed of a tungsten (W) layer. A thickness of the emitter 4 is set to be 0.1 to 0.4 μm. The thickness below 0.1 μm causes the emitter 4 to fail to exhibit satisfactory mechanical strength, whereas the thickness above 0.4 μm causes concentration of an electric field at the emitter 4 to be deteriorated, leading to a decrease in electric field strength.

In the illustrated embodiment, as described above, the emitter 4 is arranged on the portion of the substrate 2 other than the recess 3 and the gate is provided on the bottom of the recess 3, so that an interval between the emitter 4 and the gate 5 may be minutely set by minutely adjusting a thickness of the gate 5 on the order of submicrons, thus, the illustrated embodiment permits the field emission cathode to be formed into a small size as compared with photolithography conventionally used.

Figure 3:
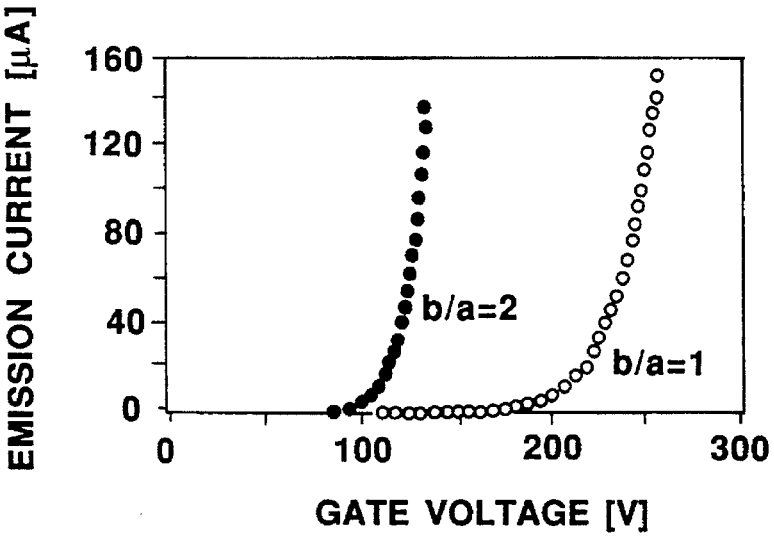
FIG. 3 is a graphical representation showing comparison of V–I characteristics between a field emission cathode of the present invention and a conventional field emission cathode.
Figure 4:
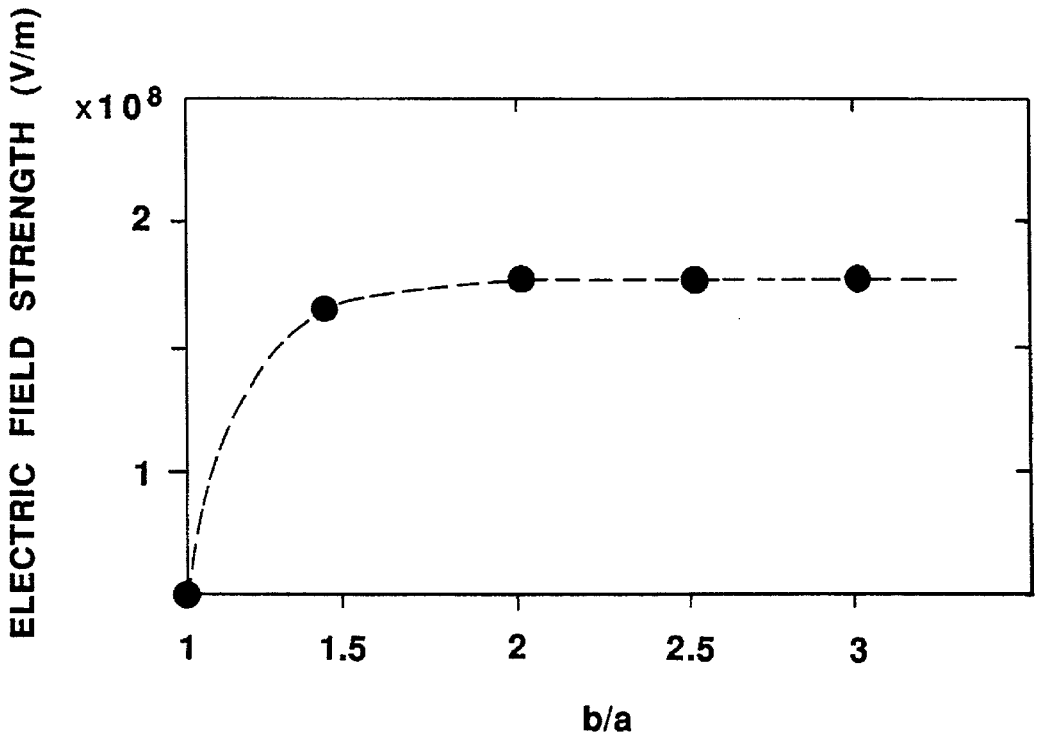
FIG. 4 is a graphical representation showing comparison of electric field strength between a field emission cathode of the present invention and a conventional field emission cathode.

The field emission cathode of the illustrated embodiment wherein the relationship between the tip width a and the tip interval b is defined to be $b/a=2$ exhibits excellent voltage-current characteristics as compared with the conventional field emission cathode wherein the relationship is $b/a=1$, as shown in FIG. 3. Also, as shown in FIG. 4, it exhibits increased electric field strength.

Figure 5A:
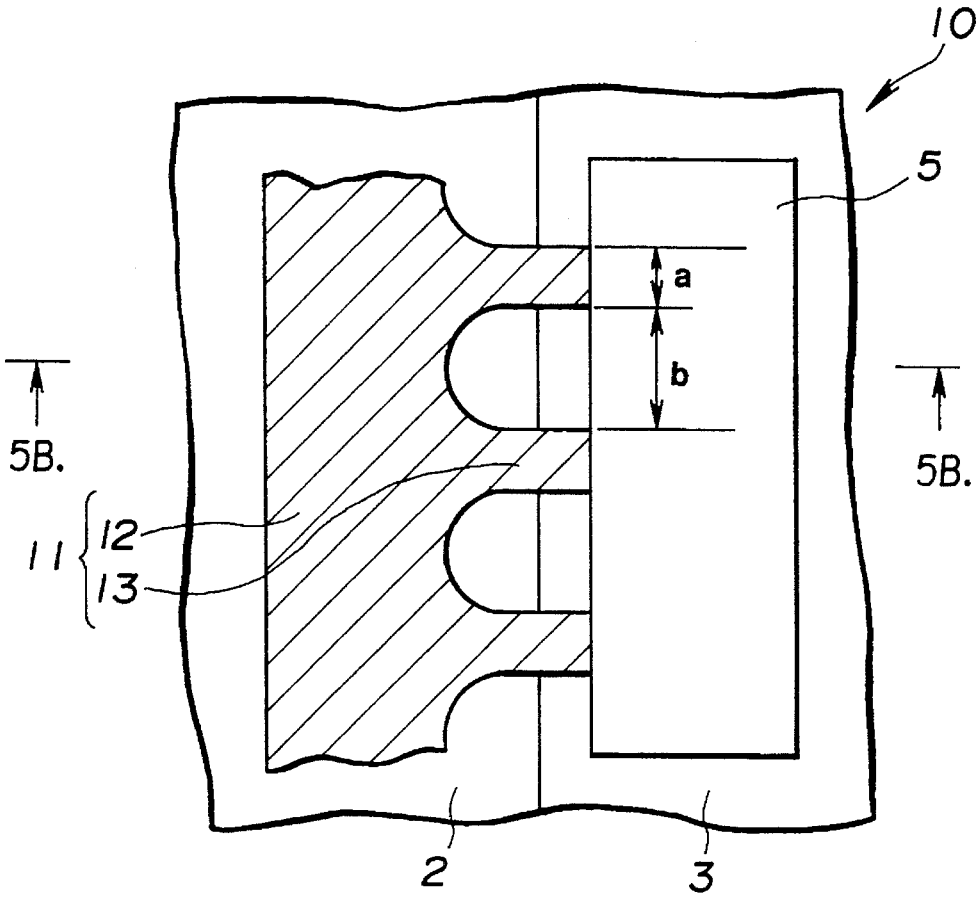
FIG. 5A is a fragmentary sectional plan view showing a second embodiment of a field emission cathode according to the present invention.
Figure 5B:
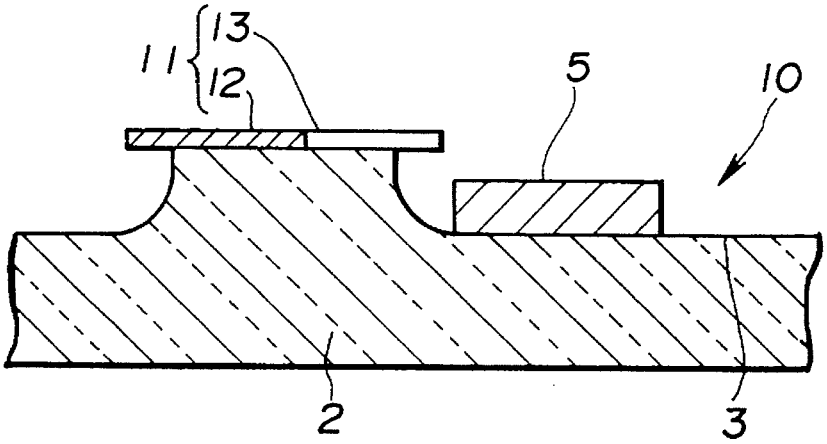
FIG. 5B is a vertical sectional view taken along line VB—VB of FIG. 5A.

Referring now to FIGS. 5A and 5B, a second embodiment of a field emission cathode according to the present invention is illustrated. A field emission cathode of the illustrated second embodiment which is generally designated at reference numeral 10 is constructed in such a manner that a boundary or connection area between rectangular tips 13 of an emitter 11 and a base 12 thereof is radiused to substantially the same degree as a width of the tip 13. Such a construction increases mechanical strength of the rectangular tips 13 to a degree sufficient to permit the emitter 11 to bear increased electric field strength, resulting in the emitter emitting an electric current in an increased amount. The remaining part of the illustrated embodiment may be constructed in substantially the same manner as the first embodiment described above.

Figure 6A:
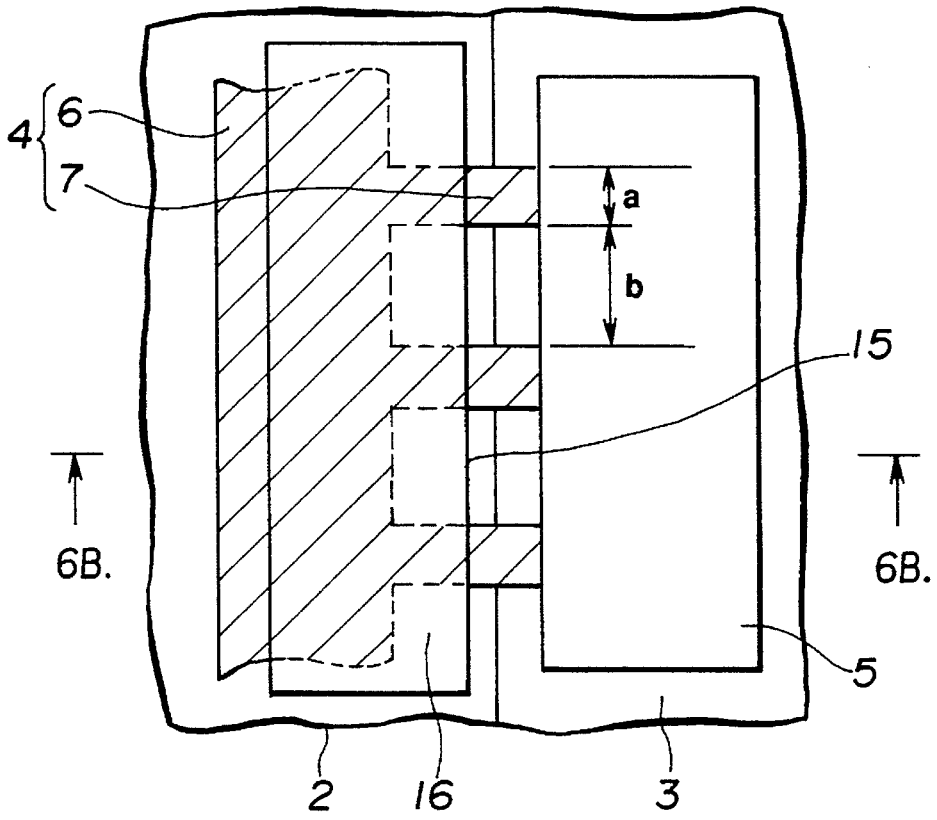
FIG. 6A is a fragmentary sectional plan view showing a further or third embodiment of a field emission cathode according to the present invention.
Figure 6B:
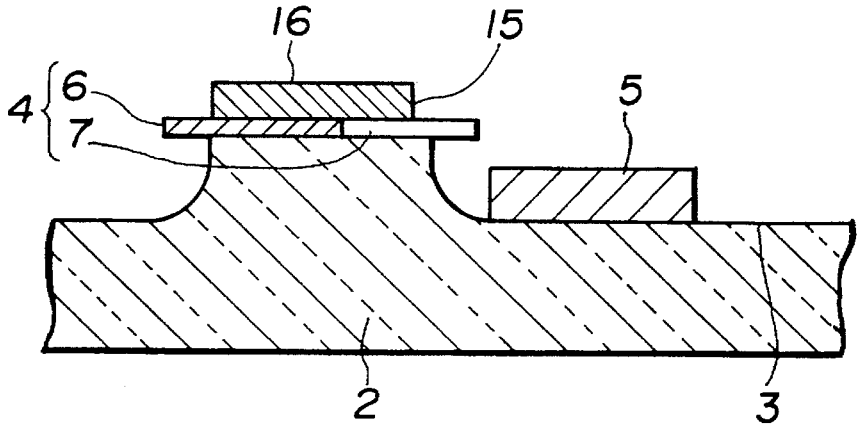
FIG. 6B is a vertical sectional view taken along line VIB—VIB of FIG. 6A.

FIGS. 6A and 6B show a further or third embodiment of a field emission cathode according to the present invention. In a field emission cathode of the illustrated third embodiment, an electrode layer 16 is arranged on an upper surface of an emitter 4 in such a manner that a distal end 15 of the electrode layer 16 is positioned at a location retracted by a distance substantially equal to an interval between tips 7 of the emitter 4 facing a gate 5 and the gate 5 or more from the tips 7 of the emitter 4. The electrode layer 16 may be made of a metal layer or a semiconductor layer. Such an arrangement of the electrode layer 16 improves strength of the rectangular tips 7 and decreases electric resistance of the emitter 4 to permit the amount of current emitted from the emitter 4 to be significantly increased. The remaining part of the embodiment may be constructed in substantially the same manner as the above-described embodiments.

Figure 7A:
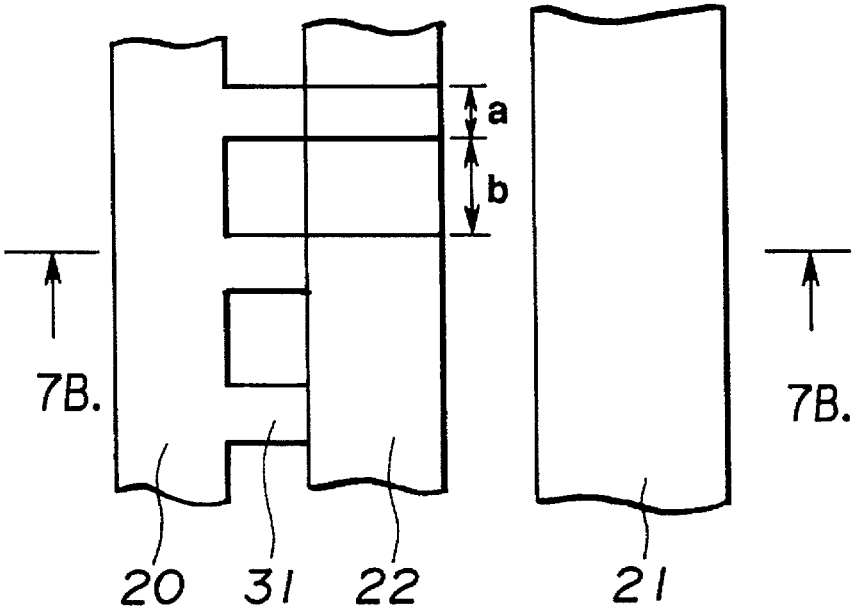
FIG. 7A is a fragmentary plan view showing a fourth embodiment of a field emission cathode according to the present invention.
Figure 7B:
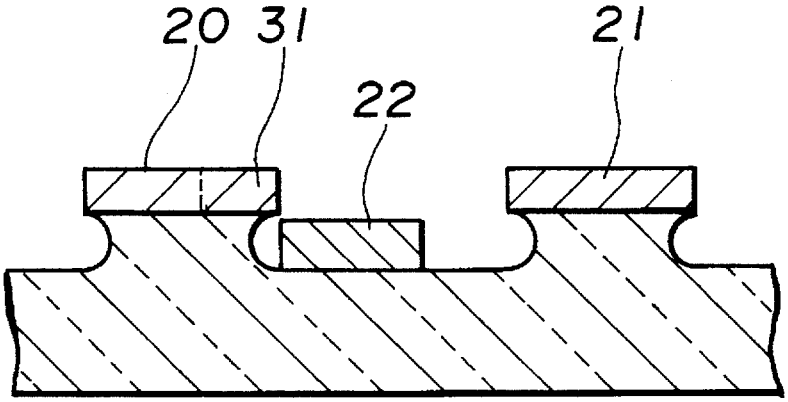
FIG. 7B is a vertical sectional view taken along line VIIB—VIIB of FIG. 7A.

Referring now to FIGS. 7A and 7B, still another embodiment of a field emission cathode according to the present invention is illustrated. A field emission cathode of the illustrated embodiment is a modification of the first embodiment and is constructed into a triode structure which includes, in addition to an emitter and a gate, a collector on which electrons emitted are adapted to impinge.

More particularly, the field emission cathode of the illustrated embodiment, as in the first to third embodiments, is so constructed that an emitter 20 and a collector 21 are arranged on a substrate and a gate 22 is arranged on a recess formed on a portion of the substrate between the emitter 20 and the collector 21.

The emitter 20 includes a plurality of rectangular tips 31, resulting in being formed into a pectinate shape when it is viewed from above. In the illustrated embodiment, a relationship or ratio of a width a of each of the tips to intervals b between the tips is defined to be $b/a=2$, so that an electric field is concentrated at each of the rectangular tips to provide increased electric field strength. Also, such a construction of the emitter permits the emitter to have a long life as compared with an emitter including triangular tips. The emitter may be made of metal such as Mo, W and the like. Alternatively, it may be formed of a base made of metal such as Ti, Al or the like and a compound semiconductor film made of a material such as $LaB_6$ or the like and deposited on the base.

In the illustrated embodiment, the collector 21 may be provided thereon with a phosphor. This permits the phosphor to emit light upon the impinging of electrons thereon. Thus, the illustrated embodiment may be effectively applicable to a luminous device utilizing a principle of a fluorescent display device, a display device of the self-emission type, or the like. As described above, the illustrated embodiment permits a large amount of current to be produced in the emitter 20 due to increased electric field strength, resulting in exhibiting luminance sufficient to permit it to be used for a luminous device or a display device. Further, the field emission cathode of the embodiment exhibits satisfactory durability, so that high reliability may be ensured when it is used for a luminous device or a display device.

Figure 8A:
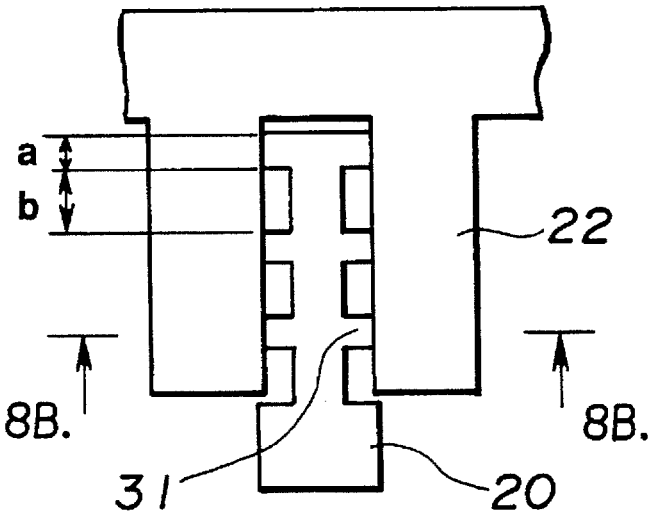
FIG. 8A is a fragmentary plan view showing a fifth embodiment of a field emission cathode according to the present invention.
Figure 8B:
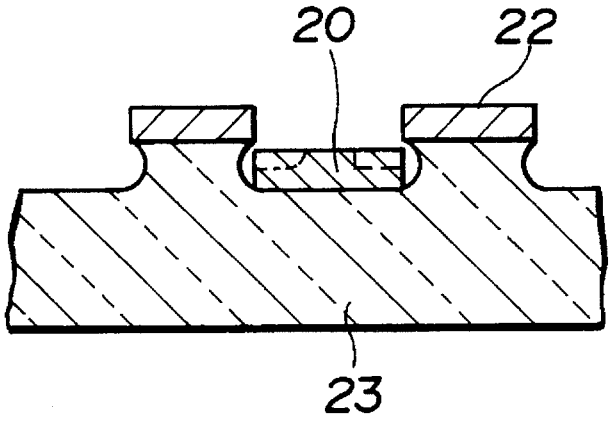
FIG. 8B is a vertical sectional view taken along line VIIIB—VIIIB of FIG. 8A.

FIGS. 8A and 8B show a fifth embodiment of a field emission cathode according to the present invention. In a field emission cathode of the illustrated fifth embodiment, an emitter 20 is formed in a recess of a substrate 23 and a gate 22 is arranged on a portion of the substrate 23 other than the recess so as to be positioned above the emitter 20. Also, the gate 22 is arranged so as to surround the emitter 20. The emitter 20, as shown in FIG. 8A, is formed at a portion thereof facing the gate 22 with a plurality of rectangular tips 31, resulting in a structure being generally formed into a pectinate shape. Further, a relationship or ratio of a width a of each of the tips 31 to an interval b between each adjacent two of the tips 31 is defined to be b/a=2 as in the embodiments described above.

The above-described fourth embodiment is constructed into a triode structure. However, fourth and fifth electrodes may be further provided to form the embodiment into a multi-electrode tube structure.

In each of the embodiments described above, the emitter is formed of a single metal layer. Alternatively, it may be formed of two or more layers made of plural kinds of materials. Further, the gate may be likewise formed of a single metal layer. Alternatively, it may be formed of two or more layers made of plural kinds of materials.

Also, the above-described embodiments each are constructed into a planar structure. However, the present invention may be applied to every structure such as a structure of a thin film edge type, a wedge type structure or the like. For example, the present invention may be embodied in such a configuration as shown in FIG. 9, wherein a relationship or ratio of a width a of each of tips to an interval b between each adjacent two tips may be defined to be b/a>1, particularly, b/a≧2, resulting in such advantages as described above being exhibited.

Figure 9:
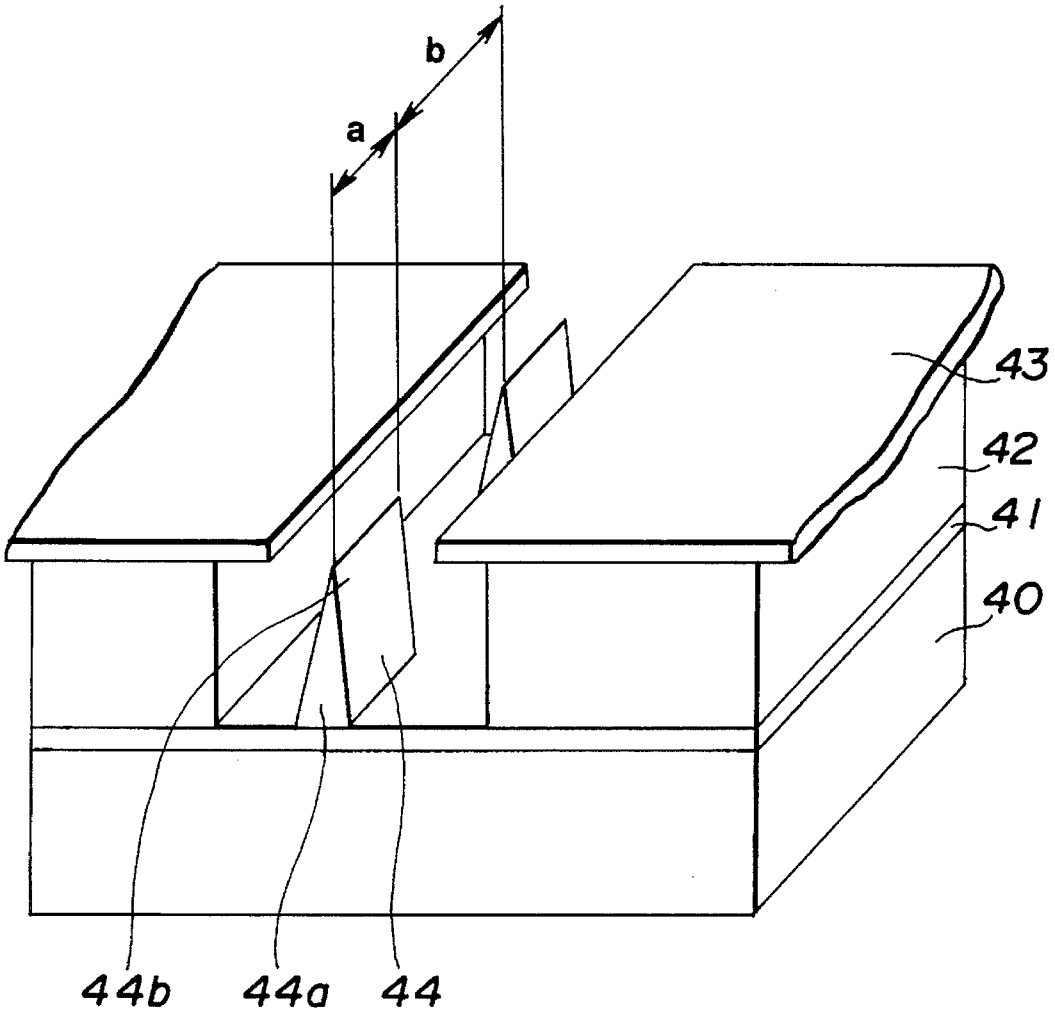
Figure 10A:
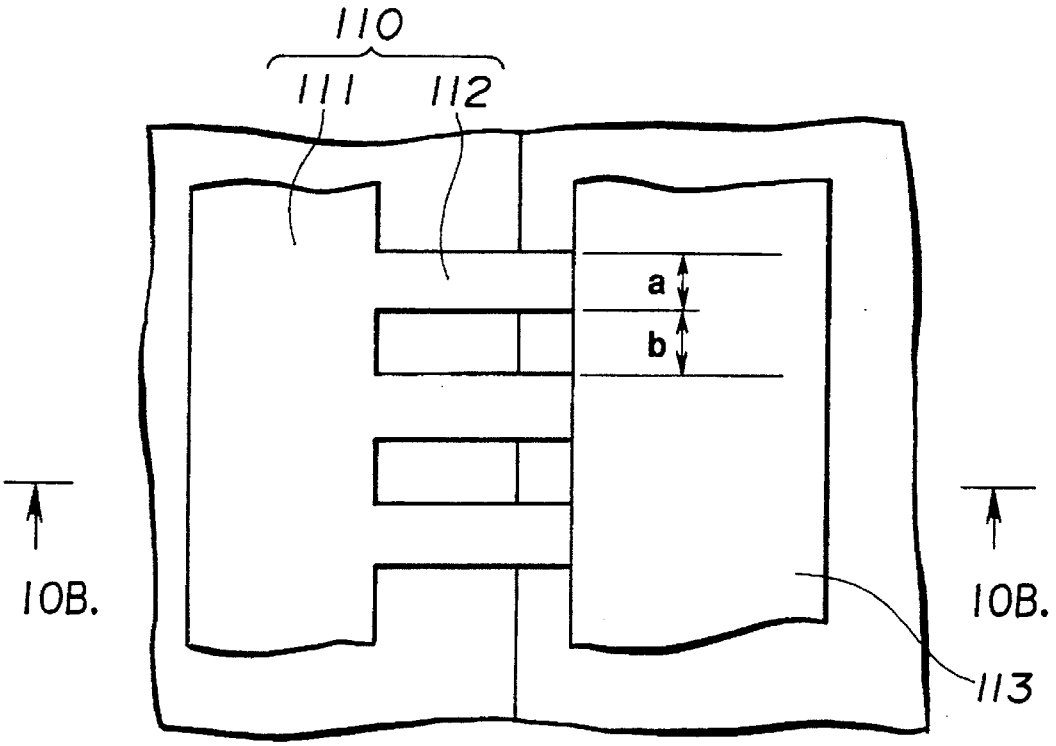
FIG. 10A is a fragmentary plan view showing a conventional field emission cathode proposed by the inventors.
Figure 10B:
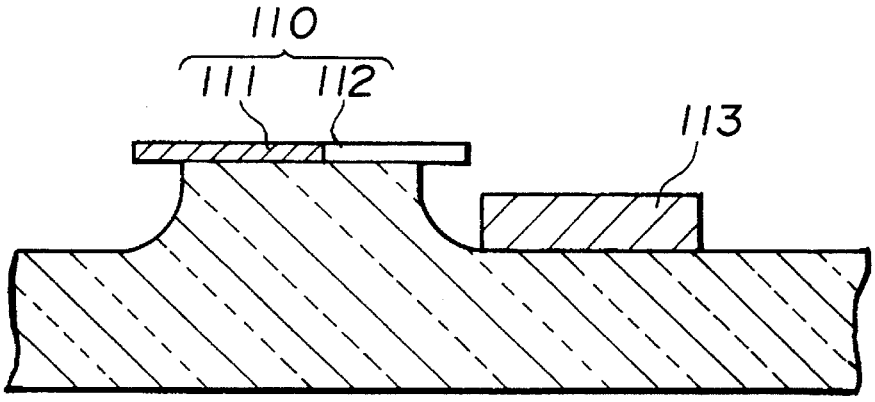
FIG. 10B is a vertical sectional view taken along line XB—XB of FIG. 10A.
Figure 11A:
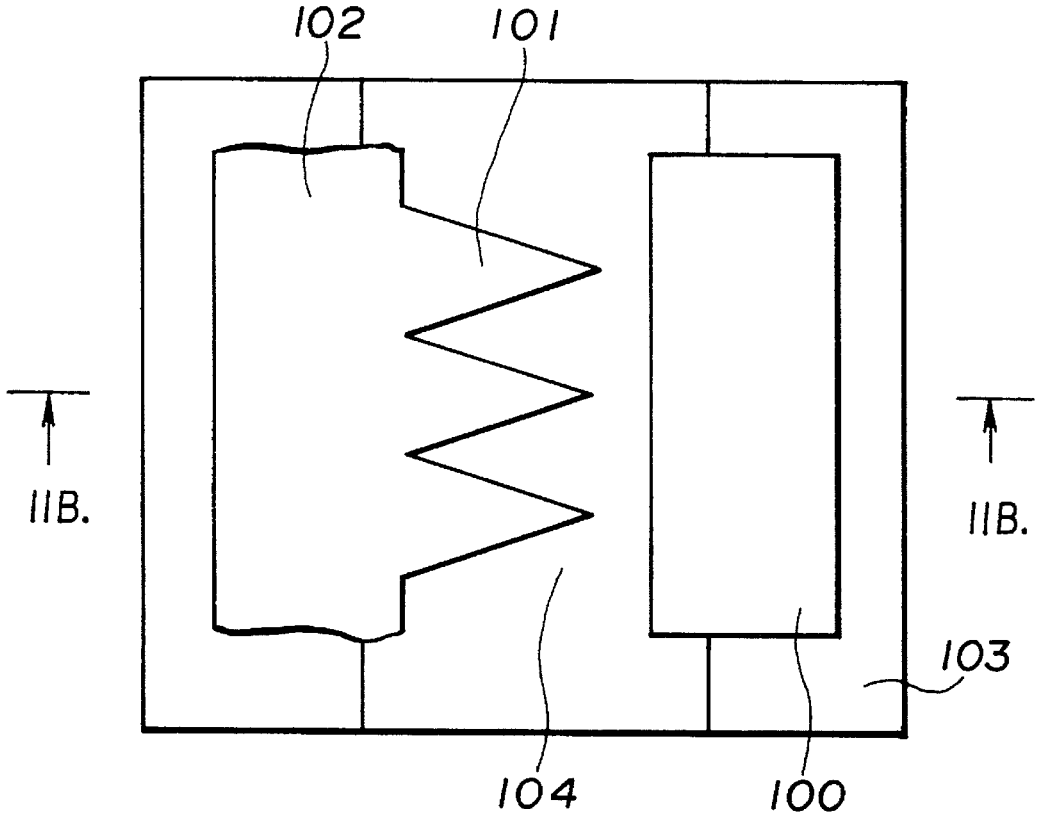
FIG.11A BACKGROUND ART
FIG. 11A is a plan view showing another conventional field emission cathode.
Figure 11B:
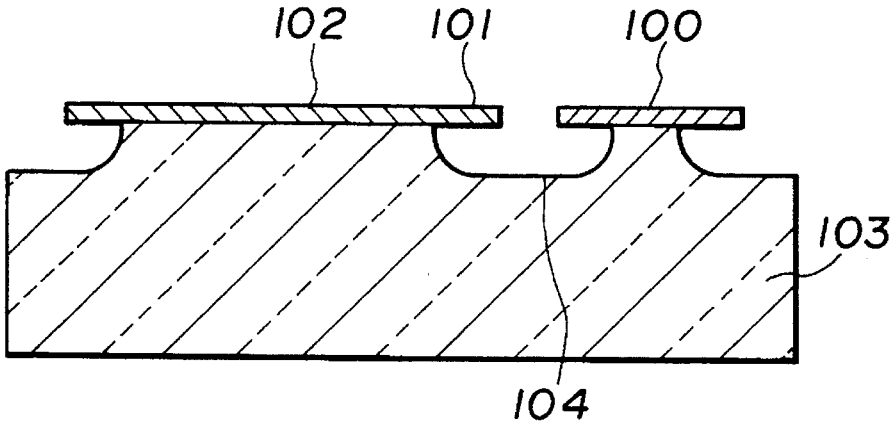
FIG.11B BACKGROUND ART
FIG. 11B is a vertical sectional view taken along line XIB—XIB of FIG. 11A.

More particularly, in an embodiment of a field emission cathode according to the present invention which is shown in FIG. 9, a cathode electrode 41 is provided on a substrate 40 made of an insulating material and then an insulating layer 42 and a gate 43 are laminated on the cathode electrode 41 in order. The field emission cathode is formed with a void in a manner to pass through the insulating layer 42 and gate 43. In the void, an emitter 44 of a substantially triangular shape is provided on the cathode electrode 41. The emitter 44 has a base 44*a* connected to the cathode electrode 41 and tips 44*b* upwardly projected. In the emitter thus constructed, a relationship or ratio of a width a of the tips 44*b* to an interval b between each adjacent two tips 44*b* is defined to be b/a=2.

As can be seen from the foregoing, in the field emission cathode of the present invention, the emitter is formed into a pectinate shape, resulting in a structure being provided with a plurality of rectangular tips and a relationship of a width a of each of the tips to an interval b between each adjacent two of the tips is defined to be b/a>1. Thus, the field emission cathode of the present invention exhibits excellent advantages as compared with the prior art wherein the relationship is b/a≦1.

An experiment was made in order to compare electric field strength between the conventional field emission cathode wherein the relationship b/a was set to be 0.5 and 1 and the field emission cathode of the present invention wherein the relationship was set to be 2, 2.5 and 3. The results were as shown in FIG. 4. More particularly, an increase in b relative to a leads to an increase in electric field strength of the emitter. Accordingly, the dimensional condition of a and b is b/a>1 and preferably b/a≧2.

Another experiment was made in order to measure an emission current produced when a cathode voltage applied is set at 0 to 300 V in each of the conventional field emission cathode wherein the relationship b/a is set to be 1 and the field emission cathode of the present invention wherein it is 2. The results were as shown in FIG. 3. In the prior art, an emission start voltage (threshold electric field) is about 150 V and a voltage of 200 V or more is required to obtain a necessary emission current. On the contrary, the present invention wherein the relationship b/a is 2 decreases the emission start voltage to 80 V, resulting in the structure being driven at a low operation voltage.

Moreover, the present invention may be so constructed that the boundary or connection area between the tips of the emitter and the base thereof is radiused and the electrode layer is arranged on the upper surface of the emitter for reinforcing the emitter. Such a construction increases mechanical strength of the emitter, to thereby prevent thermal damage of the emitter due to an emitter current, resulting in a life of the emitter and therefore the field emission cathode being significantly prolonged.

While preferred embodiments of the invention have been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A field emission device comprising:

an insulating substrate having a planar surface and a recess;

a gate formed on said recess; and an emitter formed on said planar surface, said emitter having a pectinate shape including a plurality of rectangular tips of a predetermined pitch at a distal end thereof and said tips being formed substantially on a same plane with an edge of said gate when viewed from above so as to satisfy a relationship of b/a≧2, wherein a represents an edge width of each of said tips and b represents an interval between each adjacent two of said tips.

2. A field emission device as defined in claim 1, wherein an area between each adjacent of said tips is formed into a predetermined curvature radius.

3. A field emission device as defined in claim 1, further comprising an electrode layer arranged on said emitter so that a distal end of said electrode layer is located at a position retracted from a distal end of said tips of said emitter.

4. A field emission device as defined in claim 1, wherein said tips are formed so as to satisfy the relationship of $c/a=(b+a)/a=3$, wherein c further represents the pitch of said tips.

5. A field emission device as defined in claim 1, further comprising a collector formed on said planar surface in a coplanar configuration with said emitter and spaced apart by said recess.

6. A field emission device as defined in claim 5, wherein said collector is provided with a phosphor.

* * * * *